US006609615B2

(12) United States Patent
Lin

(10) Patent No.: US 6,609,615 B2
(45) Date of Patent: Aug. 26, 2003

(54) SUPPORTING FRAME FOR A GOLF BAG

(75) Inventor: Sen-Te Lin, Changhua Hsien (TW)

(73) Assignee: Nai Hui MFG Enterprise Co., Ltd., Changhua Hsien (TW)

( * ) Notice: Subject to any disclaimer, the term of this patent is extended or adjusted under 35 U.S.C. 154(b) by 130 days.

(21) Appl. No.: 10/002,206

(22) Filed: Dec. 5, 2001

(65) Prior Publication Data

US 2003/0102234 A1 Jun. 5, 2003

(51) Int. Cl.[7] ..... A63B 55/00
(52) U.S. Cl. ..... 206/315.7; 248/96
(58) Field of Search ..... 206/315.7, 315.3; 248/96

(56) References Cited

U.S. PATENT DOCUMENTS 1,438,311 A * 12/1922 Kerlogue ..... 248/96
4,798,357 A * 1/1989 Cho ..... 248/96
5,799,786 A * 9/1998 Beck et al. ..... 248/96 X
5,934,624 A * 8/1999 Suk ..... 248/96
6,220,433 B1 * 4/2001 Kang ..... 248/96 X
6,241,201 B1 * 6/2001 Wang ..... 206/315.7 X
6,315,117 B1 * 11/2001 Han ..... 206/315.7
6,382,572 B1 * 5/2002 Lin ..... 206/315.7 X

* cited by examiner

*Primary Examiner*—Tri M. Mai
(74) *Attorney, Agent, or Firm*—Troxell Law Office PLLC

(57) ABSTRACT

A supporting frame structure for a golf bag mainly mounted to a golf bag is made up of a compression spring, a linking rod, a linking rod top cover, a linking rod bottom base, a linkage pivot block, a pivot connector, a driving block, two coupling sleeves, two supporting legs and a fixing mount. The supporting legs are in pivotal connection to the fixing mount secured to the golf bag by way of the coupling sleeves. The coupling sleeves are also pivotally connected to the linkage pivot block in pivotal connection to the pivot slider which is further in pivotal engagement with the driving block; and the linking rod is fixed to the driving block so as to permit the linkage pivot block to be driven to slide up and down as the linking rod is actuated. Accordingly the linking rod secured to the driving block can be driven up and down with the help of the spring to extend or collect the supporting legs. Such a structure permits the supporting frame to be operated with ease, safety and speed.

1 Claim, 5 Drawing Sheets

SUPPORTING FRAME FOR A GOLF BAG

BACKGROUND OF THE INVENTION

The present invention relates to a supporting frame structure for a golf bag. It is mainly mounted to a golf bag and is made up of a compression spring, a linking rod, a linking rod top cover, a linking rod bottom base, a linkage pivot block, a pivot connector, a driving block, two coupling sleeves, two supporting legs and a fixing mount. The supporting legs are in pivotal connection to the fixing mount secured to the golf bag by way of the coupling sleeves. The coupling sleeves are also pivotally connected to the linkage pivot block in pivotal connection to the pivot connector which is further in pivotal engagement with the driving block; and the linking rod is fixed to the driving block so as to permit the linkage pivot block to be driven to slide up and down as the linking rod is actuated at its bottom end. Accordingly the linking rod secured to the driving block can be driven up and down with the help of the spring to extend or collect the supporting legs. Such a structure permits the supporting frame to be operated with ease, safety and speed.

A typical prior art supporting frame is made up of a first and second resilient pieces, a driving board and a pair of supporting legs. The first resilient piece made of steel and hooked to the driving board is easily got stuck as the driving board disposed at the bottom of a golf bag is activated as a result of the rigidity of the first resilient piece being uncertain in mass production. As the extension and collection of the two supporting legs are controlled by the relief and extension of the second resilient piece, a retaining piece can be easily damaged by the excessive force of the spring retracted supporting legs in practical operation.

SUMMARY OF THE INVENTION

The primary object of the present invention is to provide an improved supporting frame for a golf bag. It can be operated with convenience, speed and less effort by simply pushing the golf bag into a tilted position or vertical position in practical use.

Another object of the present invention is to provide an improved supporting frame for a golf bag which is designed to operate in a firm and safe manner without easy damage of its structure.

DETAILED DESCRIPTION OF THE PREFERRED EMBODIMENT

Figure 1:
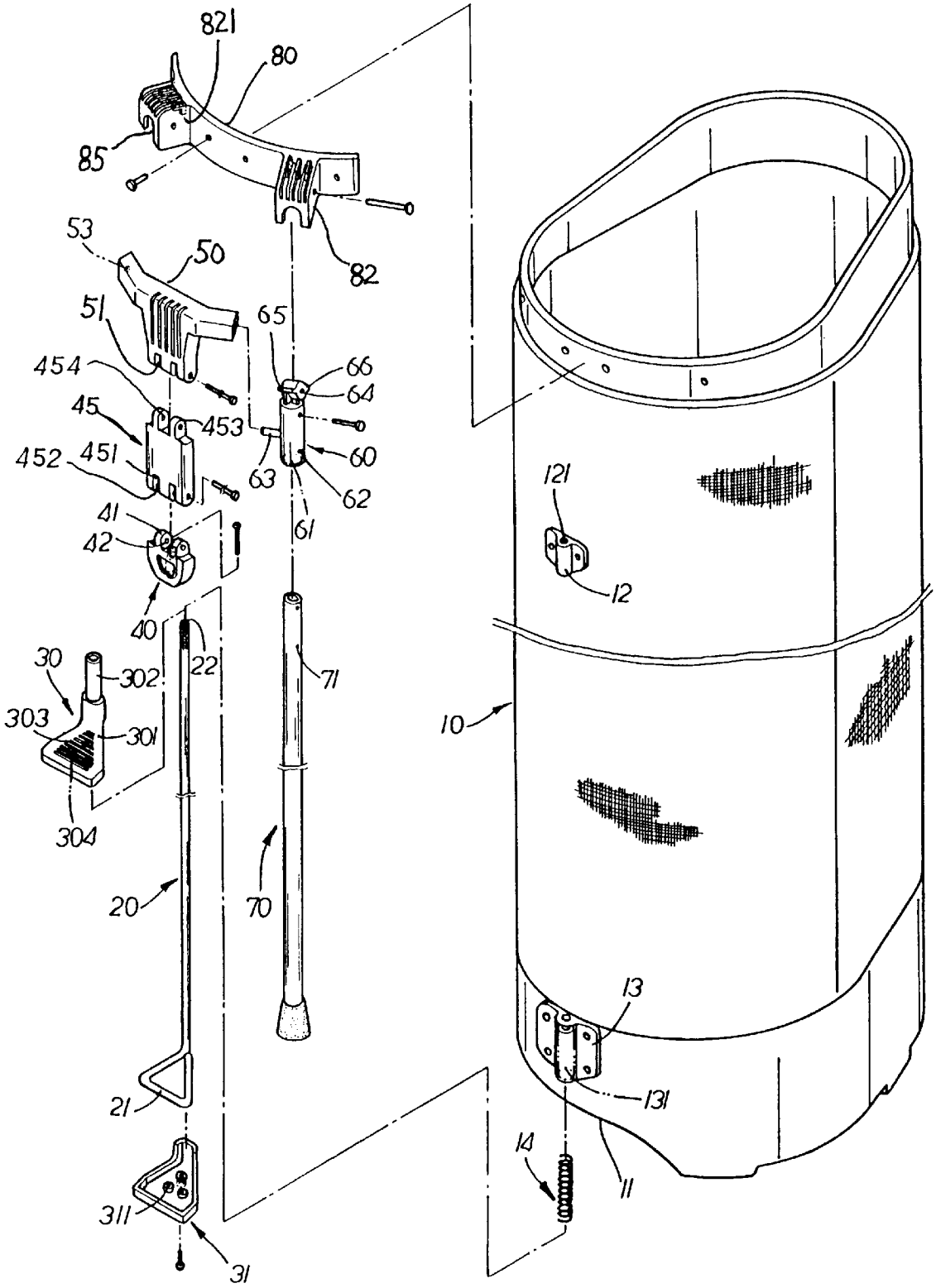
FIG. 1 is a perspective diagram showing the exploded components of the present invention.

Referring to FIG. 1, the supporting frame for a golf bag of the present invention comprises a fixing mount 80 attached to a top end of a golf bag 10, a linking rod 20, a linking rod top cover 30 and a linking rod lower base 31, a linkage pivot block 50, a pivot connector 45, a driving block 40, a spring 14, a pair of coupling sleeves 60 and a pair of supporting legs 70.

The fixing mount 80 having a plurality of rivet holes 81 is fixed to the top end of the golf bag 10 by rivets and has a pair of symmetrically disposed hollow housing projectors 82 each of which has a plurality of spaced retaining units 821 at a top edge thereof. At both sides of each housing projector 82 is disposed a pivot hole 84 and the external side thereof is disposed a dodge recess 85.

On a rear side of the golf bag 10 are disposed a first tubular retaining means 12 near the top and a second tubular retaining means 13 near a bottom for firmly holding the linking rod 20 in place which can move up and down freely.

The linking rod 20 in sliding engagement with the first and second retaining means 12, 13 has at its bottom a triangular supporting base 21 outwardly bent and an axially extended countersunk locking hole 22 at a top end thereof The linking rod top cover 30 engaged with the triangular supporting base 21 of the linking rod 20 has a cover block 301 terminating in a vertical connecting tube 302 and a plurality of locking studs 304 disposed thereunder. The linking rod 20 is led through the vertical connecting tube 302 in assembly.

The linking rod lower base 31 matches with the top cover 30 and has a plurality of screw locking holes 311 corresponding to the locking studs 304 of the top cover 30 so that the top cover 30 and the lower base 31 can be integrally locked together with the triangular base 21 sandwiched therebetween.

The linkage pivot lock 50 has a pair of insertion recesses 51 at the bottom end and a registration hole 53 at an external end of each of two symmetric horizontal top extensions.

The pivot connector 45 has a pair of two lugs 453, each having a horizontal pivot hole 454, at the top end and a pair of two insertion recesses 451 at the bottom end thereof. On the wall of each insertion recess 451 is defined a horizontal pivot hole 452. The pivot connector 45 is in pivotal connection to the linkage pivot block 50.

The driving block 40 has a pair of lugs 41 at the top thereof and a horizontal pivot hole 42 is disposed on each lug 41. The driving block 40 is pivotally coupled to the pivot connector 45 and is further fixed to the linking rod 20 so that the activation of the linking rod 20 can result in the pivotal movement of the driving block 40, the pivot connector 45 and the linkage pivot block 50.

The spring 14 is housed in a tubular hole 131 of the second tubular retaining means 13 and is in limiting contact with a bottom end of the tubular connecting tube 302.

The coupling sleeve 60 is equipped with a tubular section 61 on which are disposed a couple of laterally extended retaining holes 62. At the middle of the sleeve 60 is disposed a horizontally projected pivot pin 63 and to the top end thereof is secured a retaining head which has a lateral pivot hole 64, a relief positioning rib 65 and a collection positioning rib 66.

Each supporting leg 70 having a locking hole 71 adjacent the top end thereof is integrally fixed to each coupling sleeve 60 at a top end thereof. The locking holes 71 are defined in alignment with the retaining holes 62 of each coupling sleeve 60.

Figure 2:
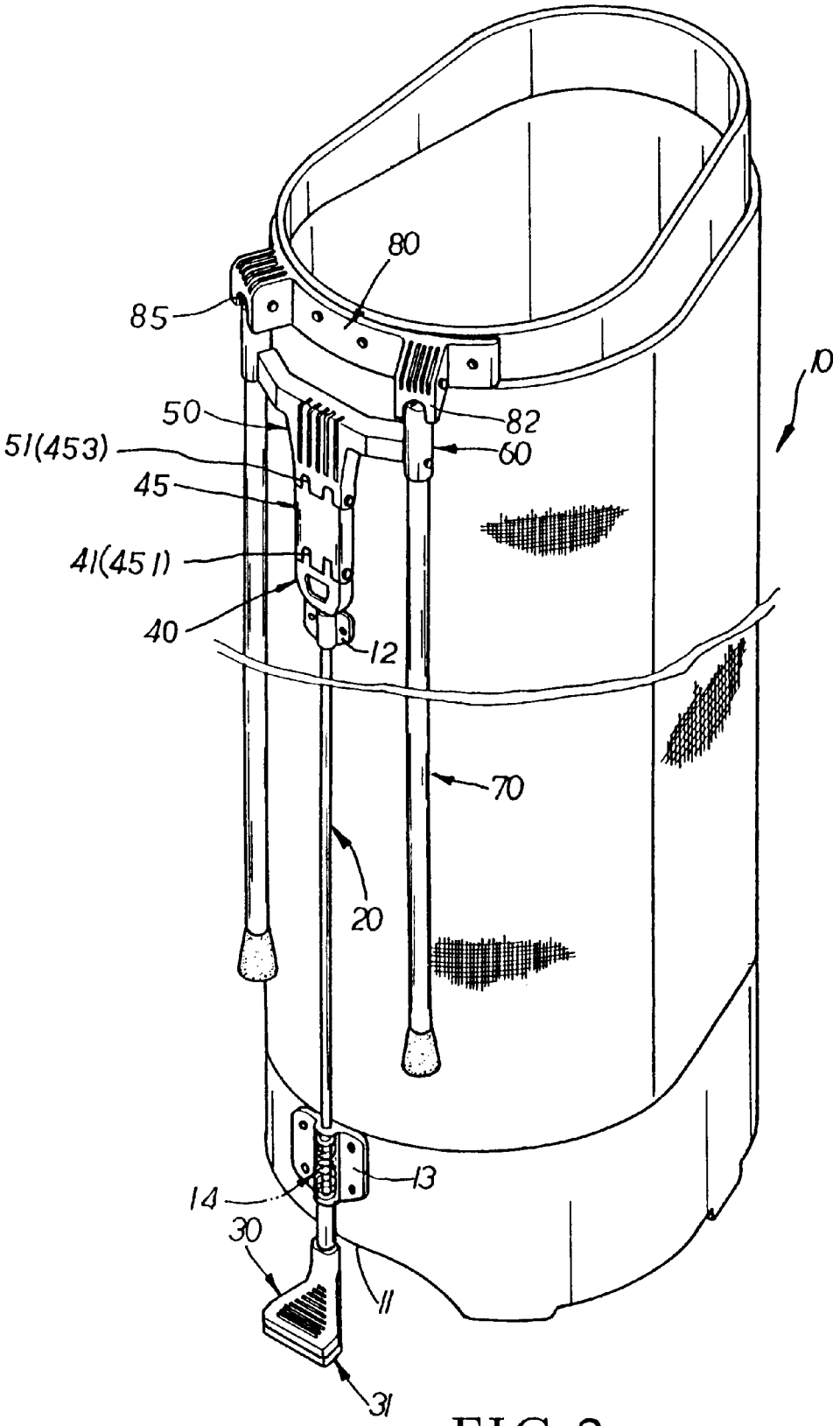
FIG. 2 is a perspective diagram showing the assembly thereof.

In assembly, as shown in FIG. 2, the linkage pivot block 50 is in pivotal engagement with the coupling sleeves 60 at the top horizontal extensions thereof and the bottom end of the linkage pivot block 50 is in pivotal connection to the pivot connector 45 by way of the lugs 453 and the insertion recesses 51 joined by a pivot pin. The driving block 40 is secured to the linking rod 20 at one end and is further pivotally engaged with the bottom end of the pivot connector 45 by way of the lugs 41 of the driving block 40 and the insertion recesses 451 of the pivot connector 45. The supporting legs 70 are securely engaged with each other by pins led through the retaining holes 62 and the locking holes 71 of the supporting legs 70. The coupling sleeves 60 are further in pivotal engagement with the housing projectors 82 of the fixing mount 80 which is secured to the top edge of the golf bag 10.

Figure 3:
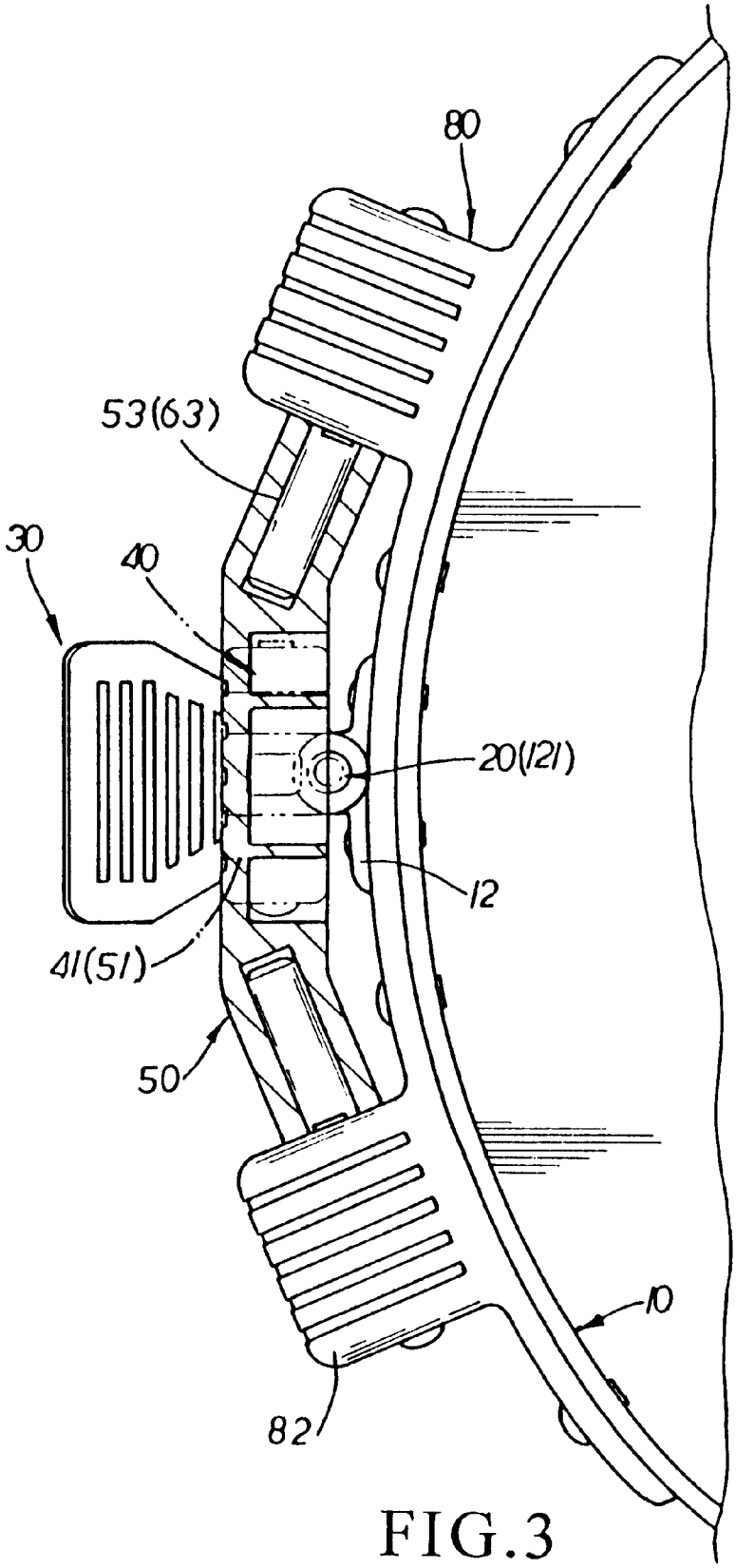
FIG. 3 is a top view thereof.
Figure 4:
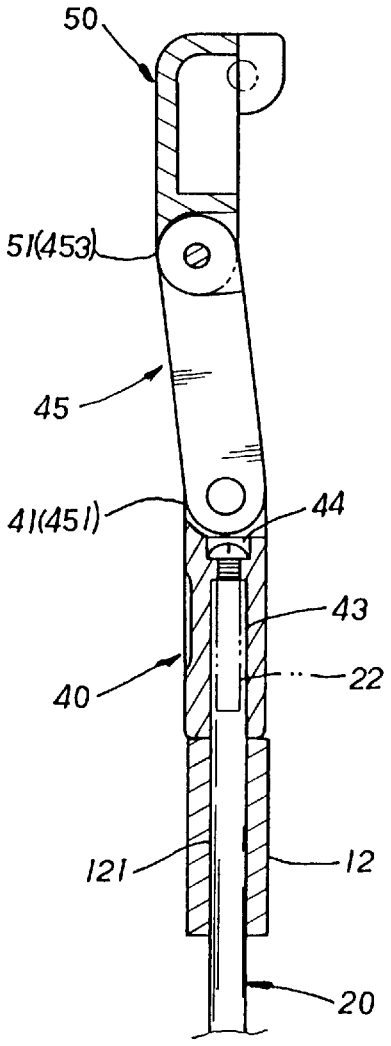
FIG. 4 is a sectional diagram showing the partial structure of FIG. 2.
Figure 5:
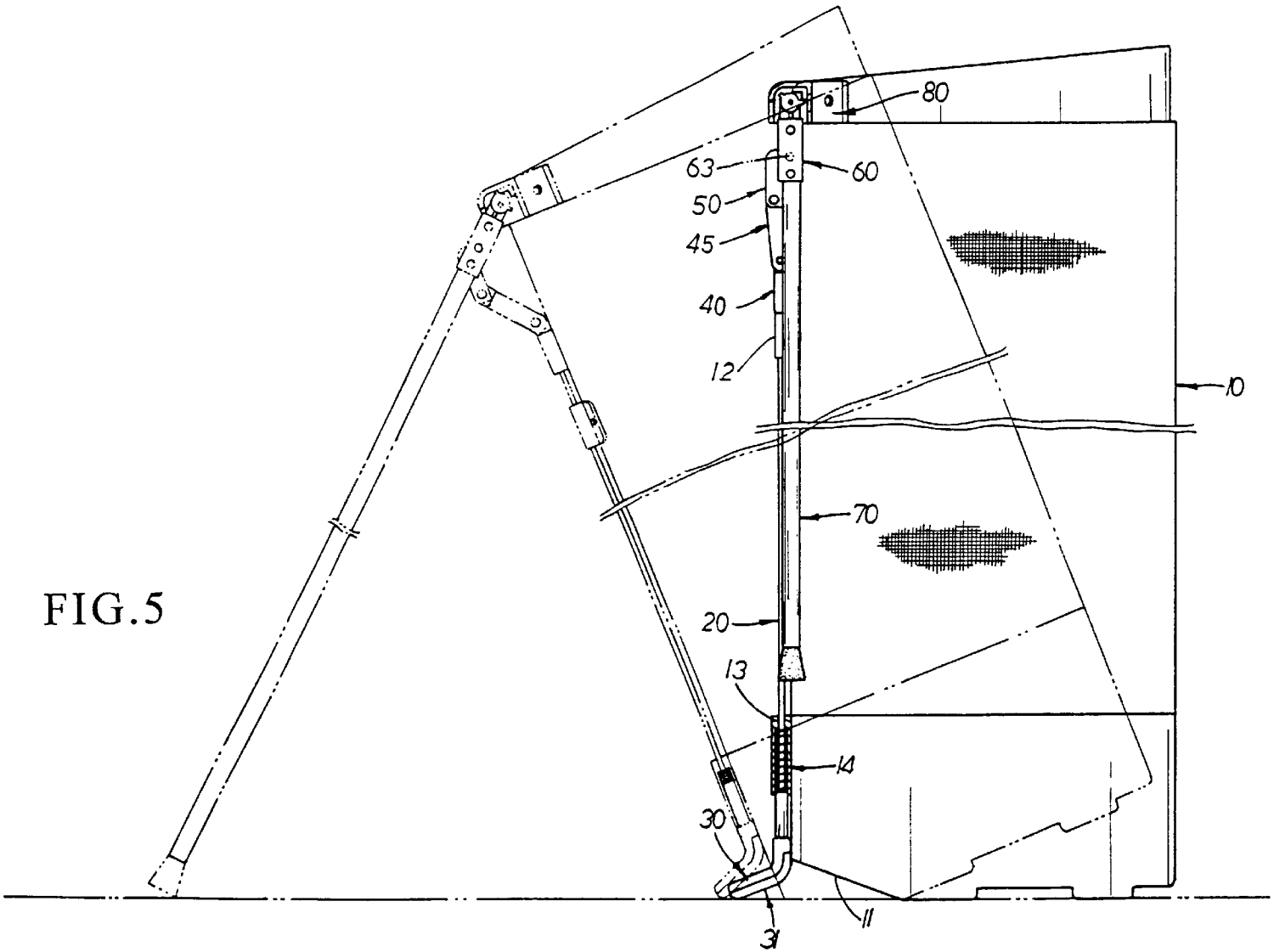
FIG. 5 is a diagram showing the operation mode of the present invention.

Referring to FIGS. 3, 4, the coupling sleeves 60 are further in pivotal connection to the linkage pivot connector 50. The linking rod 20 fixed to the driving block 40 is limited to slide up and down along the first and second tubular retaining means 12, 13 of the golf bag 10. The spring 14 confined in the second tubular retaining means permits the linking rod 20 to extend and retract back and forth. As the triangular base 21 covered by the top cover 30 and the lower base 31 of the linking rod 20 is in contact with a floor as a result of the golf bag 10 being tilted. The linkage pivot block 50 can be driven by the pivot connector 45 in connection to the linking rod 20 by the driving block 40 to outwardly extend or retract, resulting in the extension or collection of said supporting legs 70, as shown in FIG. 5. When the golf bag 10 is placed in a vertical position, the linking rod 20 is retracted by the spring 14, resulting in the linkage pivot block 50 pivoted by the pivot connector 45 driven by the driving block 40 which is pulled by the linking rod 20 retracted by the spring 14 whereby the supporting rods 70 are collected to linearly lean against the golf bag 10 along with the linkage pivot block 50, the pivot connector 45 and the driving block 40.

Figure 6:
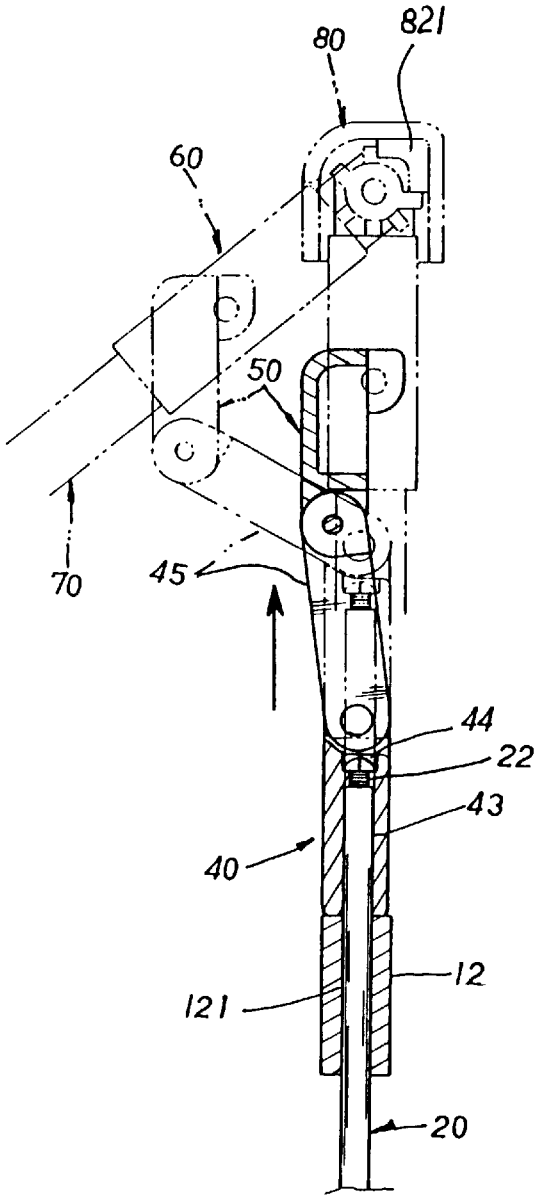
FIG. 6 is a partially sectional diagram of FIG. 5.

Referring to FIG. 6, in brief, as the golf bag 10 is placed in a tilted position, the lower base 31 of the linking rod 20 is in contact with the ground, the linking rod 20 will be pushed upwardly a small distance, the spring 14 is accordingly compressed, resulting in the driving block 40 being pushed upwardly to get the pivot connector 45 pivoted upwardly. As a result the coupling sleeves 60 and the supporting legs 70 are outwardly extended to lean against the ground and the relief positioning rib 65 of the retaining head moves to the upper side of the spaced retaining units 821 of the fixing mount 80. Thus, the supporting legs 70 are limited to extend in a proper angle so as to prevent the damage of the housing projectors 82.

I claim:

1. A supporting frame for a golf bag, comprising:

a fixing mount attached to a top end of said golf bag, a linking rod, a linking rod top cover and a linking rod lower base, a linkage pivot block, a pivot connector, a driving block, a spring, a pair of coupling sleeves and a pair of supporting legs; wherein:

said fixing mount is fixed to a top end of said golf bag and has a pair of symmetrically disposed hollow housing projectors each of which has a plurality of spaced retaining units at a top edge thereof; at both sides of each said housing projector is disposed a pivot hole and an external side thereof is disposed a dodge recess;

on a rear side of said golf bag are disposed a first tubular retaining means near the top and a second tubular retaining means near a bottom for firmly holding said linking rod in place which can move up and down freely;

said linkage pivot lock has a pair of insertion recesses at the bottom end and a registration hole at an external end of each of two symmetric horizontal top extensions;

said pivot connector has a pair of two lugs, each having a horizontal pivot hole, at the top end and a pair of two insertion recesses, at the bottom end thereof; on the wall of each insertion recess is defined a horizontal pivot hole; said pivot connector is in pivotal connection to said linkage pivot block;

said driving block has a pair of lugs at the top thereof and a horizontal pivot hole is disposed on each lug; said driving block is pivotally coupled to said pivot connector and is further fixed to said linking rod so that the activation of said linking rod can result in the movement of said driving block, said pivot connector and said linkage pivot block;

said linking rod in sliding engagement with said first and second retaining means has at its bottom a triangular supporting base outwardly bent and an axially extended locking hole at a top end thereof;

said linking rod top cover engaged with said triangular supporting base of said linking rod has a cover block terminating in a vertical connecting tube and a plurality of locking studs disposed thereunder; said linking rod is led through said vertical connecting tube;

said lower base matches with said top cover and has a plurality of screw locking holes corresponding to said locking studs of said top cover so that said top cover and said lower base can be integrally locked together with said triangular base sandwiched therebetween;

said spring is housed in said second tubular retaining means and is in limiting contact with a top end of said vertical connecting tube;

each coupling sleeve is equipped with a tubular section on which are disposed a couple of laterally extended retaining holes adjacent a bottom end of said sleeve is disposed a projected tube section and to a top end thereof is secured a retaining head which has a lateral pivot hole, a relief positioning rib and a collection positioning rib;

each of said supporting legs is integrally fixed to each of said coupling sleeves at a top end thereof;

whereby said coupling sleeves and said supporting legs are securely engaged with each other; and said coupling sleeves are further in pivotal engagement with said housing projectors of said fixing mount which is secured to the top edge of said golf bag; and said coupling sleeves are further in pivotal connection to said linkage pivot block; and said linking rod is fixed to said driving block which is limited to slide up and down along said first and second tubular retaining means of said golf bag; said spring confined in said second tubular retaining means can retract said linking rod back and forth; and as said triangular base covered by said top cover and said lower base of said linking rod is in contact with a floor with said golf bag tilted, said linkage pivot block is driven by said pivot connector in connection to said linking rod by said driving block to outwardly extend, resulting in the extension or collection of said supporting legs; when said golf bag is placed in a vertical position, the linking rod is retracted by said spring, resulting in said linkage pivot block pivoted by said pivot block driven by said driving block which is pulled by said linking rod retracted by said spring whereby said supporting rods are collected to linearly lean against said golf bag along with said linkage pivot block, said pivot connector and said driving block.

* * * * *